US006225734B1

(12) United States Patent
Heo

(10) Patent No.: US 6,225,734 B1
(45) Date of Patent: May 1, 2001

(54) FLAT PANEL CATHODE-RAY TUBE HAVING IMPROVED SUPPORT FRAME

(75) Inventor: Tae-weon Heo, Pusan (KR)

(73) Assignee: Samsung Display Devices Co., Ltd., Kyungki-do ( * ) Notice: Subject to any disclaimer, the term of this patent is extended or adjusted under 35 U.S.C. 154(b) by 0 days.

(21) Appl. No.: 09/209,289

(22) Filed: Dec. 11, 1998

(30) Foreign Application Priority Data

Dec. 15, 1997 (KR) ..... 97-68878

(51) Int. Cl.[7] ..... H01J 29/80
(52) U.S. Cl. ..... 313/402; 313/407; 313/408
(58) Field of Search ..... 313/402, 404, 313/406, 407, 408

(56) References Cited

U.S. PATENT DOCUMENTS 4,739,215 * 4/1988 Adamski et al. ..... 313/402
5,532,545 * 7/1996 Okamoto et al. ..... 313/402
5,952,774 * 9/1999 Diven et al. ..... 313/402

* cited by examiner

*Primary Examiner*—Michael H. Day
*Assistant Examiner*—Joseph Williams
(74) *Attorney, Agent, or Firm*—Lowe Hauptman Gilman & Berner, LLP

(57) ABSTRACT

A cathode-ray tube having a flat face including a panel having a flat screen surface and provided with a support portion at the inner surfaces of a skirt portion at the periphery thereof, a frame supported by the support portion of the panel, a flat tension mask fixed to the frame in a tensioned state, and a funnel joined to the panel for end thereof to support the frame.

7 Claims, 3 Drawing Sheets

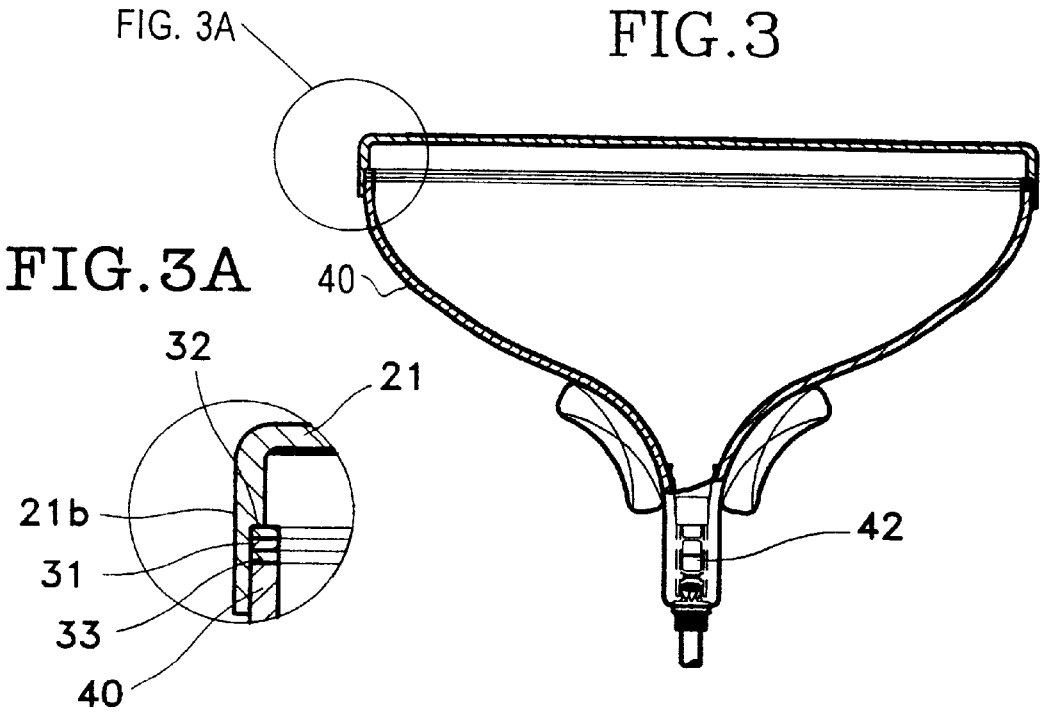
FIG. 3A
FIG.3
FIG.3A
40
32
21
21b
31
33
40
42
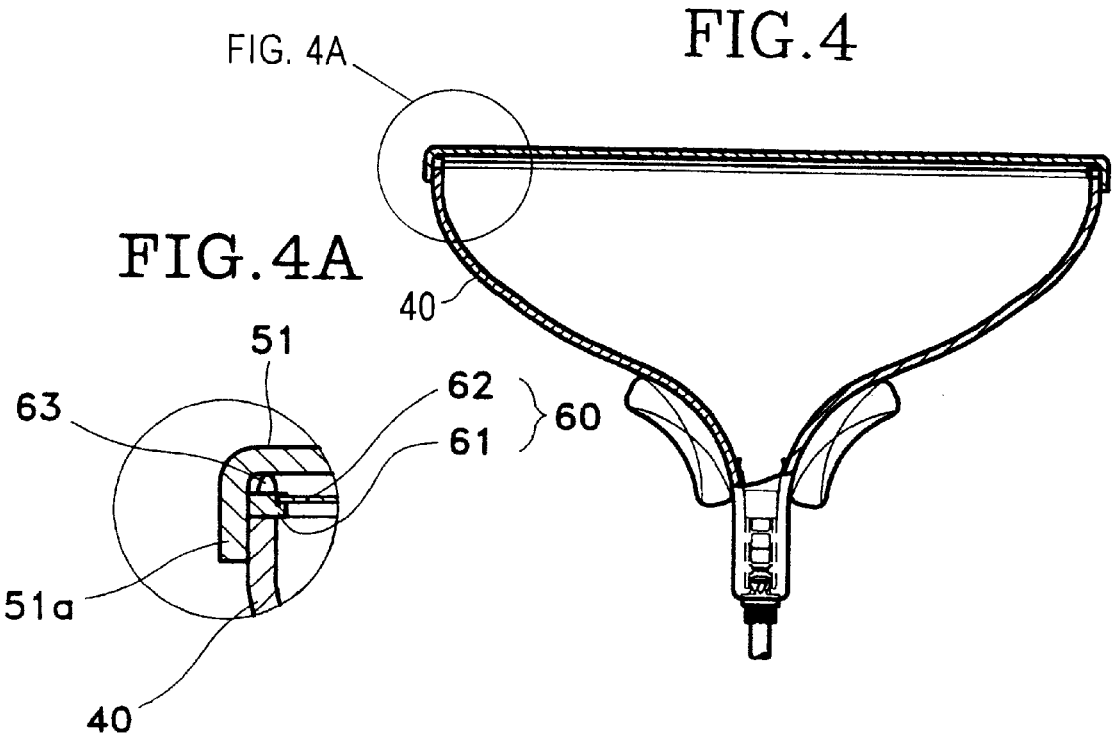
FIG. 4A
FIG.4
FIG.4A
40
51
63
62
61
60
51a
40

FIG.5
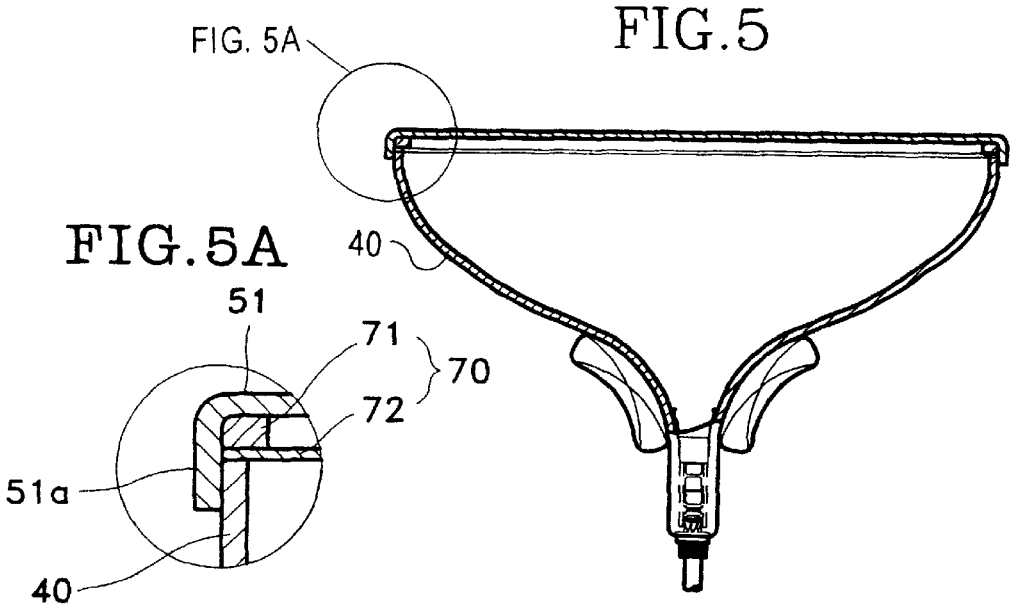
FIG.5A
FIG.6
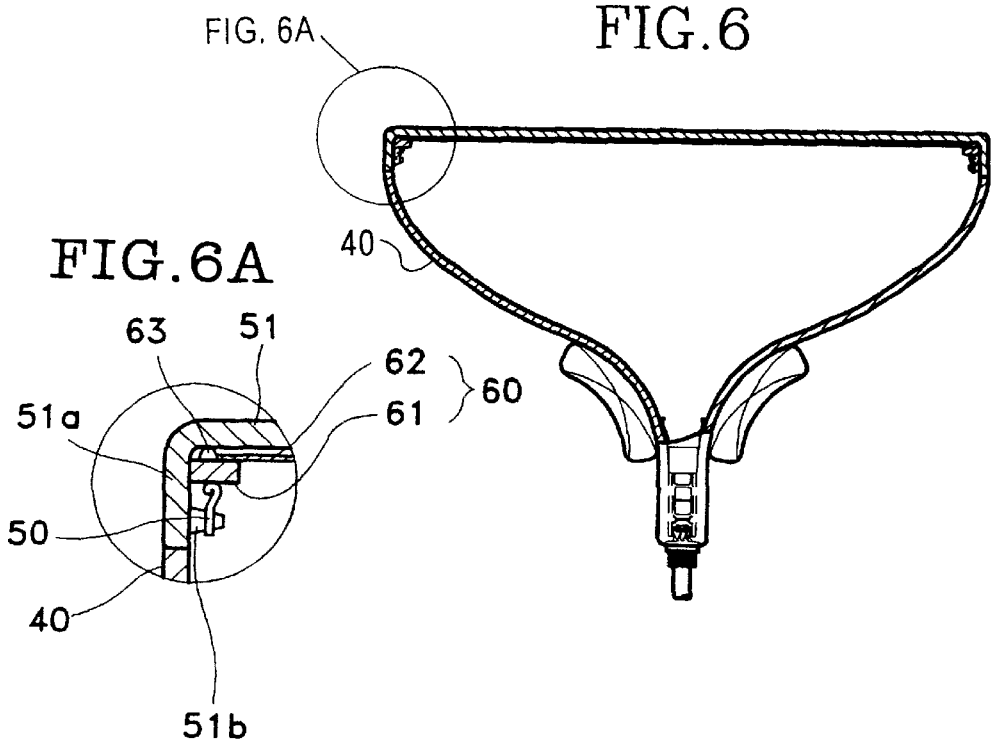
FIG.6A

FLAT PANEL CATHODE-RAY TUBE HAVING IMPROVED SUPPORT FRAME

BACKGROUND OF THE INVENTION

1. Field of the Invention

The present invention relates to a cathode-ray tube having a flat face, and more particularly, to a cathode-ray tube in which the installation structure of a tension mask is improved.

2. Description of the Related Art

In a color cathode-ray tube, electron beams emitted from electron guns pass through electron beam passing holes of a shadow mask which has a color separation function and land on a phosphorescent film, and thereby excite a phosphorescent material to form images.

The screen surface of a conventional color cathode-ray tube is designed to have a predetermined curvature considering trajectories of electron beams emitted from the electron guns and deflected by a deflection yoke, and also the shadow mask is designed to have a curvature corresponding to the curvature of the screen surface. During the operation of the color cathode-ray tube having the structure as above, the shadow mask is heated by the electron beams, i.e., thermal electrons emitted from the electron guns and experiences a doming effect in which the shadow mask domes toward the screen. The doming effect causes the electron beams to land not exactly on the phosphorescent screen. In addition, since the screen surface of a conventional color cathode-ray tube has the predetermined curvature, there are problems in which the angle of view is narrow and images are distorted at the edge portions of the screen surface.

A cathode-ray tube having a flat screen surface is developed in order to solve the above problems, and comprises a flat panel provided with a phosphorescent film and a mask fixed to the panel in a state applied with a predetermined tension.

FIG. 1 shows a support system for a tension mask of a cathode-ray tube having a flat face, and the support system is disclosed in U.S. Pat. No. 4,900,977. As shown in FIG. 1, a support frame 12 is fitted to a panel 11 provided with a sealing portion 11 a along the peripheral part of the panel 11, and a tension mask 13 is fixed to the upper edge of the support frame 12.

In the above structure, the stepped sealing portion 11*a* must be provided along the peripheral part of the panel 11 in order to fix the tension mask 13 to the panel 11. Further, distance deviation between the tension mask 13 and the phosphorescent film formed on the inner surface of the panel 11 may be serious depending on the fixation state of the support frame 12 to the panel 11.

SUMMARY OF THE INVENTION

To solve the above problems, it is an objective of the present invention to provide a cathode-ray tube having a flat face in which the distance between a tension mask and a panel can be uniformly maintained.

Accordingly, to achieve the above objective, there is provided a cathode-ray tube having a flat face including a panel having a flat screen surface and provided with a support portion at the inner surfaces of a skirt portion at the periphery thereof, a frame supported by the support portion of the panel, a flat tension mask fixed to the frame in a tensioned state, and a funnel joined to the panel for end thereof to support the frame.

According to another embodiment of the present invention, there is provided a cathode-ray tube having a flat face including a panel having a flat screen surface and provided with a skirt portion at the periphery thereof, a frame joined to the skirt portion to contact the inner surfaces thereof, a flat tension mask fixed to the frame in a tensioned state, a gap maintaining member interposed between the frame and the screen surface of the panel, and a funnel joined to the panel for end thereof to support the frame.

According to still another embodiment of the present invention, there is provided a cathode-ray tube having a flat face including a panel having a flat screen surface and provided with a skirt portion at the periphery thereof, a frame having a predetermined thickness and installed to contact the periphery of the screen surface of the panel, a flat tension mask fixed to the frame in a tensioned state and maintaining a predetermined gap with respect to the screen surface of the panel, and a funnel joined to the panel for end thereof to support the frame.

According to still another embodiment of the present invention, there is provided a cathode-ray tube having a flat face including a panel having a flat screen surface and provided with a skirt portion at the periphery thereof, a frame joined to the skirt portion to contact the inner surfaces thereof, a flat tension mask fixed to the frame in a tensioned state, a supporting device installed at the skirt portion for supporting the frame, and a funnel joined to the panel for end thereof to support the frame.

BRIEF DESCRIPTION OF THE DRAWINGS

The above objective and advantages of the present invention will become more apparent by describing in detail a preferred embodiment thereof with reference to the attached drawings in which:

FIG. 3 is a partial section view illustrating the cathode-ray tube having a flat face of FIG. 2;

FIG. 4 is a section view illustrating another embodiment of a cathode-ray tube having a flat face according to the present invention;

FIG. 5 is a section view illustrating still another embodiment of a cathode-ray tube having a flat face according to the present invention; and FIG. 6 is a section view illustrating still another embodiment of a cathode-ray tube having a flat face according to the present invention.

DESCRIPTION OF THE PREFERRED EMBODIMENTS

Figure 1:
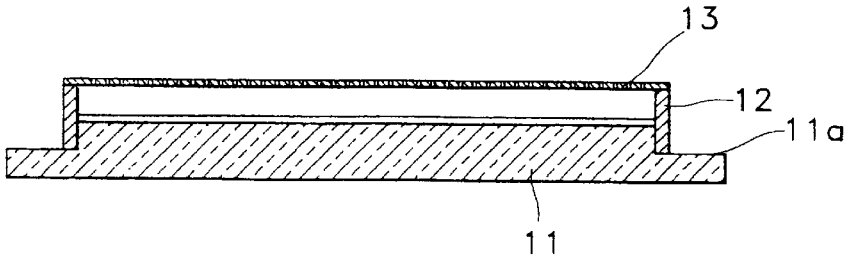
FIG. 1 (PRIOR ART)
FIG. 1 is a section view illustrating a state in which a tension mask of a conventional cathode-ray tube having a flat face is fitted to a panel.
Figure 2:
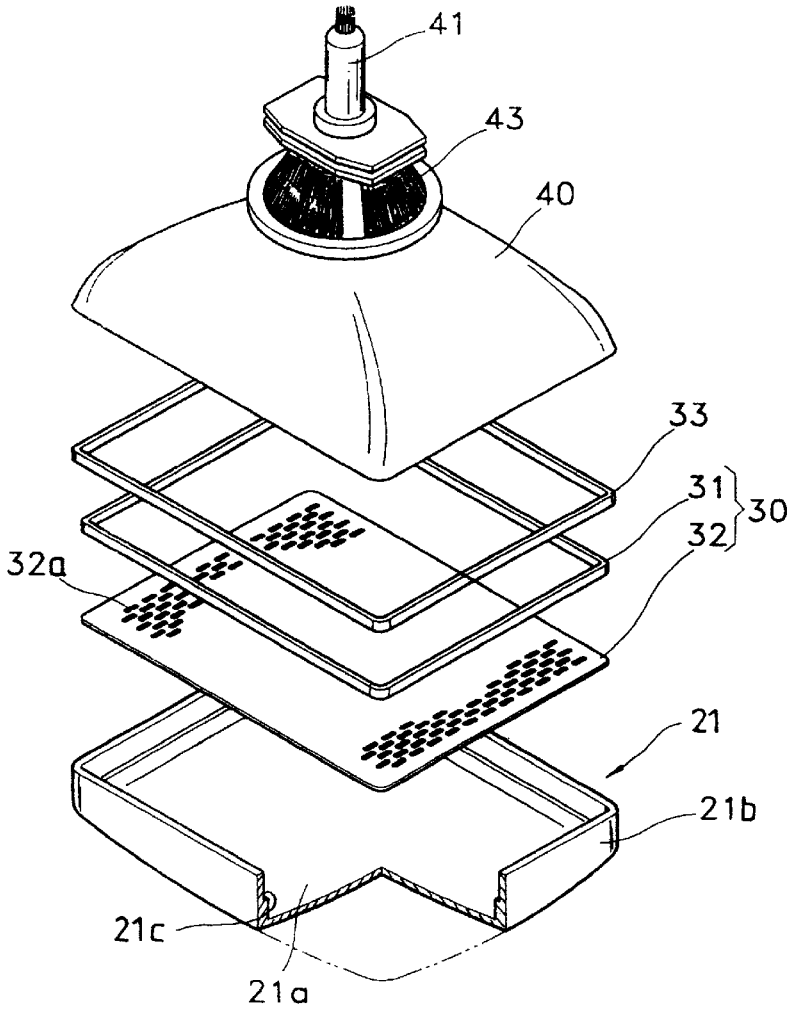
FIG. 2 is a exploded perspective view illustrating a cathode-ray tube having a flat face according to the present invention.

A cathode-ray tube having a flat face according to the present invention has a flat screen surface and a flat tension mask, and FIGS. 2 and 3 show an embodiment thereof.

As shown in FIGS. 2 and 3, a phosphorescent film 21*a* is formed on an inner surface of a panel 21, and a support portion 21*c* is formed along the inner side surfaces of a skirt portion 21*b* formed along the periphery of the panel 21. Preferably, the support portion 21*c* is formed as a stepped portion along the inner side surfaces of the panel 21. The height from the bottom surface of the panel 21 to the support portion 21*c* corresponds to a gap between a tension mask and a funnel described below.

A tension mask frame assembly 30 is fitted to the panel 21, and includes a rectangular frame 31 supported by the support portion 21*c*, and the tension mask 32 fixed to the frame 31.

The tension mask 32 is composed of a planar foil, and is provided with a plurality of electron beam passing holes 32*a* in a predetermined pattern. The tension mask 32 is fixed to the frame 31 with a predetermined tension applied thereto. To this end, the tension mask 32 is heated to a temperature higher than the temperature of the tension mask 32 during the operation of the cathode-ray tube to expand, then is fixed to the frame 31, and is cooled. Alternatively, after the frame 31 is pressed and deformed in an inward direction within an elastic deformation range, the tension mask 32 is fixed to the frame 31. Subsequently, when the frame 31 is released from a elastically pressed state, the tension mask 32 is fixed to the frame 31 in a tensioned state.

Fixing the tension mask 32 to the frame 31 is done by bonding or welding. In case of welding, it is preferable that the welding is done by seam welding or laser welding along the periphery of the tension mask 32.

The panel 21 is sealed to the funnel 40. At this time, the funnel 40 is fitted to the panel 21 as shown in FIG. 3, and the edge of the funnel 40 presses the frame 31. Here, a supporter 33 may be installed between the frame 31 and the end of the funnel 40. It is preferable that the supporter 33 is made of glass to enhance adhesive strength to the panel 21 and support strength of the frame 31.

Electron guns 42 are sealed into a neck 41 of the funnel 40, and a deflection yoke 43 which deflects electron beams emitted from the electron guns 42 is installed in the conic portion of the funnel 40.

In the operation of the cathode-ray tube having a flat face structured as above, the electron beams emitted from the electron guns 42 are deflected by the defection yoke 43, land on the phosphorescent film 21*a*, and thereby excite a phosphorescent material to form images. At this time, some of electron beams, i.e. only about from 15 to 30% pass through respective electron beam passing holes 32*a*, and the others of the electron beams, i.e., thermal electrons collide against the tension mask 32 and heat it. Accordingly, the tension mask 32 is thermally expanded, and since the tension mask 32 is fixed to the frame 31 in a tensioned state, the thermal expansion can be absorbed by the tensioned mask 32. Further, the remaining thermal expansion which is not absorbed by the tension mask 32 is absorbed by thermal expansion of the frame 31.

According to this embodiment, since the frame 31 to which the tension mask 32 is fixed is supported by the support portion 21*c* formed at the skirt portion 21*b* of the panel 21, the gap between the tension mask 32 and the phosphorescent film 21*a* of the panel 21 can be uniformly maintained. Further, since expansion of tension mask 32 can be effectively absorbed by the tensioned mask 32 during the operation of the cathode-ray tube, the gap between the tension mask 32 and the phosphorescent film 21*a* can be maintained to be constant.

FIG. 4 shows another embodiment of a cathode-ray tube having a flat face according to the present invention. As shown in FIG. 4, a support means such as the support portion 21*c* (FIG. 2) is not formed at the skirt portion 51*a* of a panel 51. A mask frame assembly 60 is composed of a frame 61 which is fitted into and contacts the inner surfaces of the skirt portion 51*a* of the panel 51, and a flat tension mask 62 fixed to the frame 61. The tension mask 62 is fixed to the frame 61 in a tensioned state as described above.

According to this embodiment, a gap between a phosphorescent film of the panel 51 and the tension mask 62 is maintained by a gap maintaining member 63. The gap maintaining member 63 is installed at a surface of the frame 61, which faces the screen, and is preferably a projection integrally formed with the frame 61. The frame 61 is pressed and supported by the end of a funnel 40 which is sealed to contact the inner surfaces of the skirt portion 51a of the panel 51.

According to this embodiment, the gap between the phosphorescent film and the tension mask 62 is maintained by the gap maintaining member 63, and that since the tension mask 62 is in a tensioned state, thermal expansion of the tension mask 62 is absorbed by the tensioned mask 32 as in the previous embodiment.

FIG. 5 shows still another embodiment of a cathode-ray tube having a flat face according to the present invention. Referring to FIG. 5, a mask frame assembly 70 contacts a panel 51 directly. Namely, a tension mask 72 is fixed to a rectangular frame 71 in a tensioned state with a predetermined tension, and the frame 71 contacts the inner surfaces of the peripheral portion of the panel 51.

In addition, the end of a funnel 40 sealed to the panel 51 supports the frame 71 and the tension mask 72.

Here, the thickness of the frame 71 is determined to correspond to a gap between a phosphorescent film on the inner surface of the panel 51 and the tension mask 72.

FIG. 6 shows still another embodiment of a cathode-ray tube having a flat face according to the present invention. Here, reference numerals that are the same as those shown in FIG. 4 denote like members. According to this embodiment, since the end of a funnel 40 is attached to the end of a skirt portion 51*a* of a panel 51 as shown in FIG. 6, a mask frame assembly 60 is secured by a retainer which is a separate support means.

The retainer is composed of support pins 51*b* installed at the inner surfaces of the skirt portion 51*a* of the panel 51, and a pressing spring 50 which is joined to the support pins 51 and presses and supports the frame 61.

According to the present invention, a gap between a mask frame assembly and a panel can be maintained by a support portion formed at a skirt portion of the panel, a gap maintaining member or the like. In addition, since a tension mask is fixed to a frame in a tensioned state, thermal expansion can be effectively compensated, and distortion of the tension mask can be prevented. Besides, in the present invention, since the frame is fitted to the panel after the tension mask is fixed to the frame, the assembling structure and assembling process of the mask frame assembly are simple.

Although particular embodiments of the present invention have been described with reference to the accompanying drawings for the purposes of illustration, it should be understood that various modifications and equivalents may be made by those skilled in the art without departing from the spirit and scope of the invention. Accordingly, it must be understood that the invention is limited only by the attached claims.

What is claimed is:

1. A cathode-ray tube having a flat face comprising:

a panel having a flat screen surface and provided with a support portion at inner surfaces of a skirt portion at a periphery thereof;

a frame supported by the support portion of the panel;

a flat tension mask fixed to the frame in a tensioned state; and a funnel joined to the panel at a funnel end thereof which presses the frame.

2. The cathode-ray tube as claimed in claim 1, wherein a support for supporting the frame is installed at the end of the funnel.

3. A cathode-ray tube having a flat face comprising:

a panel having a flat screen surface and provided with a skirt portion at a periphery thereof;

a frame joined to the skirt portion to contact inner surfaces thereof;

a flat tension mask fixed to the frame in a tensioned state;

a gap maintaining member interposed between the frame and the screen surface of the panel; and a funnel joined to the panel at a funnel end thereof to press the frame.

4. The cathode-ray tube as claimed in claim 3, wherein the gap maintaining member is a projection integrally formed at the frame to have a predetermined height.

5. A cathode-ray tube having a flat face comprising:

a panel having a flat screen surface and provided with a skirt portion at a periphery thereof;

a frame having a predetermined thickness and installed to contact the periphery of the screen surface of the panel;

a flat tension mask fixed to the frame in a tensioned state and maintaining a predetermined gap with respect to the screen surface of the panel; and a funnel joined to the panel at a funnel end thereof to press the frame.

6. A cathode-ray tube having a flat face comprising:

a panel having a flat screen surface and provided with a skirt portion at a periphery thereof;

a frame joined to the skirt portion to contact the inner surfaces thereof;

a flat tension mask fixed to the frame in a tensioned state;

a supporting device installed at the skirt portion for supporting the frame; and a funnel joined to the panel at a funnel end thereof to press the frame.

7. The cathode-ray tube as claimed in claim 6, wherein the supporting device includes support pins fixed to the inner surfaces of the skirt portion; and a pressing spring joined to the support pins and supporting the frame.

* * * * *